US008743011B2

(12) United States Patent
Kim

(10) Patent No.: US 8,743,011 B2
(45) Date of Patent: Jun. 3, 2014

(54) INTERNAL ANTENNA SUPPORTING WIDEBAND IMPEDANCE MATCHING

(75) Inventor: Byong-Nam Kim, Kyeonggi-Do (KR)

(73) Assignee: Ace Technologies Corporation, Incheon (KR)

( * ) Notice: Subject to any disclaimer, the term of this patent is extended or adjusted under 35 U.S.C. 154(b) by 370 days.

(21) Appl. No.: 13/133,582

(22) PCT Filed: Mar. 30, 2009

(86) PCT No.: PCT/KR2009/001599

§ 371 (c)(1),
(2), (4) Date: Jun. 8, 2011

(87) PCT Pub. No.: WO2010/067924

PCT Pub. Date: Jun. 17, 2010

(65) Prior Publication Data

US 2011/0241963 A1 Oct. 6, 2011

(30) Foreign Application Priority Data

Dec. 10, 2008 (KR) ..... 10-2008-0125477

(51) Int. Cl.
*H01Q 1/48* (2006.01)

(52) U.S. Cl.
USPC ..... 343/845

(58) Field of Classification Search
USPC ..... 343/845, 700, 700 MS
See application file for complete search history.

(56) References Cited

U.S. PATENT DOCUMENTS

| | | | | |
|---|---|---|---|---|
| 5,861,854 | A | 1/1999 | Kawahata et al. | |
| 6,683,573 | B2 * | 1/2004 | Park | 343/700 MS |
| 2004/0051665 | A1 | 3/2004 | Chen | |
| 2004/0113845 | A1 | 6/2004 | Mikkola et al. | |
| 2008/0180333 | A1 | 7/2008 | Martiskainen et al. | |

FOREIGN PATENT DOCUMENTS

| | | |
|---|---|---|
| JP | 10-013139 A | 1/1998 |
| KR | 10-799875 | 1/2008 |

* cited by examiner

*Primary Examiner* — Seung Lee
(74) *Attorney, Agent, or Firm* — Edwards Wildman Palmer LLP; Kongsik Kim; Stephen D. LeBarron

(57) ABSTRACT

An internal antenna providing impedance matching for a wide band is disclosed. The disclosed antenna may include: a substrate; an impedance matching/feeding unit comprising a feeding member, separated from the substrate at a designated distance, configured to receive RF signals, and of a designated length in a first direction, and a ground member, separated from the substrate at a designated distance, separated from the feeding member at a designated in a second direction perpendicular to the first direction, and of a designated length in the first direction; and a radiator extending from the ground member; wherein the impedance matching/feeding unit performs impedance matching by way of coupling between the feeding member and the ground member, and the radiator receives coupling feeding from the feeding member. The disclosed antenna has the advantages of overcoming the narrow band problem of a planar inverted-F antenna, and of allowing more efficient utilization of space in an internal antenna.

3 Claims, 9 Drawing Sheets

INTERNAL ANTENNA SUPPORTING WIDEBAND IMPEDANCE MATCHING

CROSS-REFERENCES TO RELATED APPLICATIONS

This application is a U.S. national phase application, pursuant to 35 U.S.C. §371, of PCT/KR2009/01599, filed Mar. 30, 2009, designating the United States, which claims priority to Korean Application No. 10-2008-0125477, filed Dec. 10, 2008. The entire contents of the aforementioned patent applications are incorporated herein by this reference.

TECHNICAL FIELD

The present invention relates to an antenna, more particularly to an internal antenna providing impedance matching for a wide band.

BACKGROUND ART

Recently there has been a demand for the ability to receive mobile communication services of different frequency bands through one mobile communication terminal, even as mobile communication terminals become smaller and lighter. There is a demand for terminals that are able to use signals of multiple bands simultaneously as necessary, for mobile communication services using a variety of frequency bands such as, for example, the CDMA service of the 824-894 MHz band and the PCS service of the 1750-1870 MHz, which have been commercialized in Korea, the CDMA service of the 832-925 MHz band, which has been commercialized in Japan, the PCS service of the 1850-1990 MHz band, which has been commercialized in the U.S., the GSM service of the 880-960 MHz band, which has been commercialized in Europe and China, and the DCS service of the 1710-1880 MHz band, which has been commercialized in parts of Europe; for accommodating such multiple bands there is a demand for an antenna having wide band characteristics.

Besides these, there is also a demand for composite terminals that are able to use services such as Bluetooth, ZigBee, wireless LAN, GPS, etc. In such a terminal for using services of multiple bands, a multiple band antenna should be used that is able to operate in two or more bands. For an antenna of a generally used mobile communication terminal, a helical antenna and a planar inverted-F antenna (PIFA) are mainly used.

Here, a helical antenna is an external antenna affixed to the top end of a terminal, and is used together with a monopole antenna. A helical and monopole antenna in combined usage is such that if the antenna is extended out of the body of the terminal, it acts as a monopole antenna, and if it is retracted, it acts as a $\lambda/4$ helical antenna. Such an antenna has the advantage of high profits, but due to its non-directivity, the SAR (specific absorption rate)—the standard for the level of harmfulness of electromagnetic waves to the human body—is not good. Also, as a helical antenna is constructed as protruding out of a terminal, it is not easy to provide an esthetic appearance and an external design suitable to portability of the terminal, and no study has been done on an internal structure with regards to this.

An inverted-F antenna is an antenna designed with a low profile structure for the purpose of overcoming such disadvantages. An inverted-F antenna has a directivity that improves its SAR by reducing the beams emitted towards the human body, left over from the beams going toward the ground, out of all the beams generated by the current left in the radiating part, while at the same time strengthening the beams left to go in the direction of the radiating part; and it may also be implemented as a low profile structure operating with a square micro-strip antenna, the length of the rectangular flat-board radiating part being reduced in half.

Since such an inverted-F antenna has radiating characteristics with a directivity that reduces the strength of beams going toward the human body and fortifies the strength of the beams going outward from the body, it has a superior electromagnetic specific absorption rate when compared with a helical antenna. However, an inverted-F antenna has the problem of having a narrow frequency band width.

The narrow frequency band width of an inverted-F antenna is due to point-matching, in which the matching with a radiator takes place at a specific point.

In order to overcome the problem related to a narrow band width due to point matching, an application was submitted for a Korean patent by the inventor, and this application presents a structure that overcomes the problem of a narrow band width of the existing inverted-F antenna by means of coupling matching and coupling feeding in a comparatively long interval.

However, there was the problem of the size of the antenna being large, as a separate impedance matching part for such coupling matching and coupling feeding occupied a comparatively large space.

Technical Problem

To resolve the problem of the related art addressed above, an aspect of the invention provides an internal antenna for a wide band for the purpose of overcoming the narrow band problem of a planar inverted-F antenna.

Another purpose of the present invention is to provide an internal antenna for a wide band that utilizes space more efficiently than an internal antenna for a wide band that uses coupling matching and coupling feeding.

Other purposes of the present invention can readily be derived by those skilled in the art from the embodiments below.

Technical Solution

To achieve the objective above, an aspect of the invention provides an internal antenna providing impedance matching for a wide band that includes a substrate; an impedance matching/feeding unit comprising a feeding member, separated from the substrate at a designated distance, configured to receive RF signals, and of a designated length in a first direction, and a ground member, separated from the substrate at a designated distance, separated from the feeding member at a designated in a second direction perpendicular to the first direction, and of a designated length in the first direction; and a radiator extending from the ground member; wherein the impedance matching/feeding unit performs impedance matching by way of coupling between the feeding member and the ground member, and the radiator receives coupling feeding from the feeding member.

The antenna may further include a feeding pin that is perpendicular to the substrate and electrically connected to a feeding point and the feeding member.

The antenna may further include a ground pin that is perpendicular to the substrate and electrically connected to a ground and the ground member.

The length of the ground member and feeding member in the first direction should preferably be approximately 0.1 of the wavelength.

The antenna may further include a carrier that is secured by the joining of the feeding member, ground member and radiator.

The carrier comprises a flat upper part and multiple wall parts, and the multiple wall parts are joined to the substrate.

The feeding member is joined to one side of one of the multiple wall parts, and the ground member is joined to the opposite side of the one side and separated at a designated distance.

Another aspect of the invention provides an internal antenna providing impedance matching for a wide band that includes a substrate; a carrier joined to the substrate; an impedance matching/feeding unit that includes a ground member joined to a first surface of one of the wall parts of the carrier and electrically connected to the ground, and a feeding member joined to a second surface opposite the first surface and configured to receive feed of RF signals; and a radiator extending from the ground and joined to the carrier.

Advantageous Effects

An embodiment of the present invention offers the advantages of overcoming the narrow band problem of a planar inverted-F antenna, and of allowing more efficient utilization of space in an internal antenna.

MODE FOR INVENTION

An internal antenna providing impedance matching for a wide band according to an embodiment of the invention will be described below in more detail with reference to the accompanying drawings.

An internal antenna providing impedance matching for a wide band according to an embodiment of the invention may be implemented with the use of a carrier, but for the sake of ease of explanation, first a description will be given of an antenna having a structure without a carrier with reference to FIGS. 1 to 3, and then later a description will be given of a structure implemented with a carrier.

Figure 1:
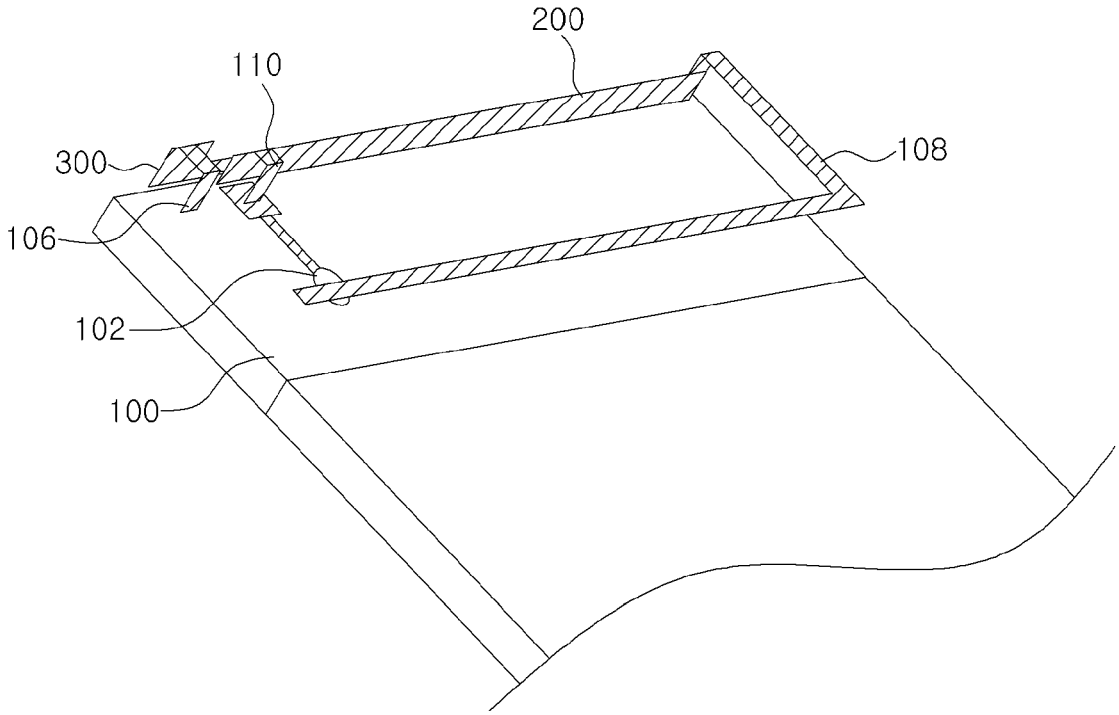
FIG. 1 is a drawing illustrating a perspective view of an internal antenna for a wide band according to an embodiment of the present invention.

FIG. 1 is a drawing illustrating a perspective view of an internal antenna for a wide band according to an embodiment of the present invention; FIG. 2 is a drawing illustrating a perspective view of the internal antenna for a wide band according to an embodiment of the present invention seen from another direction; and FIG. 3 is a drawing illustrating a plan view of the internal antenna for a wide band according to an embodiment of the present invention.

Figure 2:
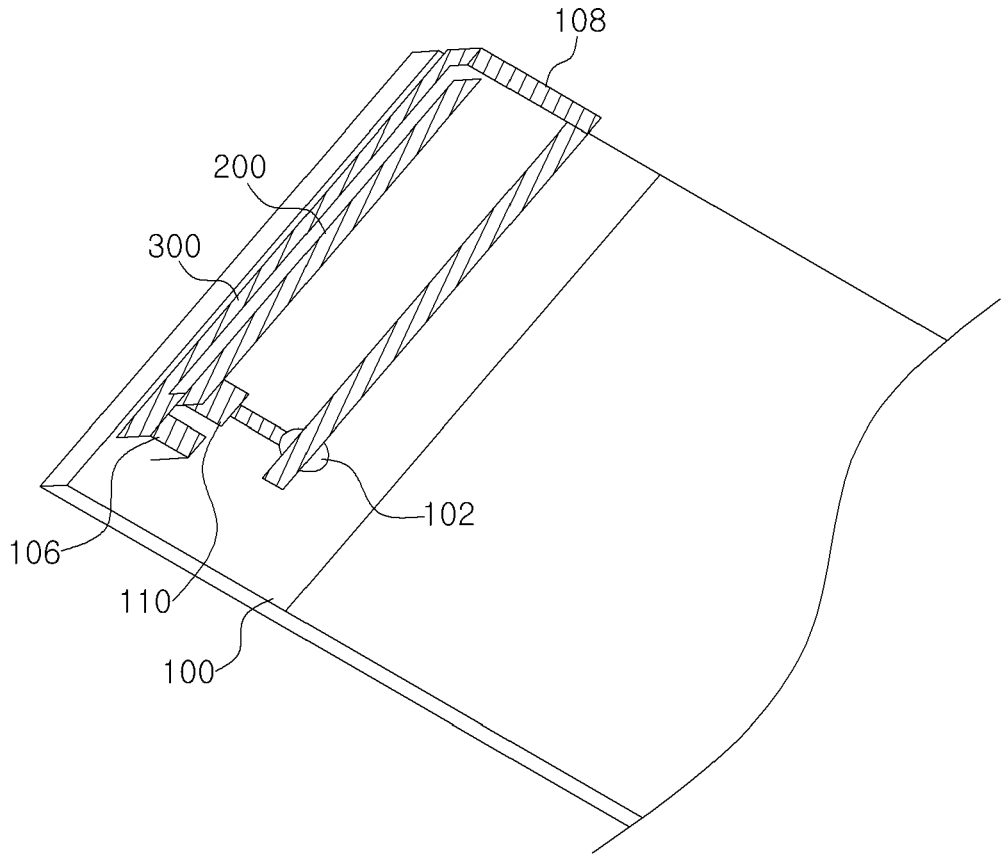
FIG. 2 is a drawing illustrating a perspective view of the internal antenna for a wide band according to an embodiment of the present invention seen from another direction.
Figure 3:
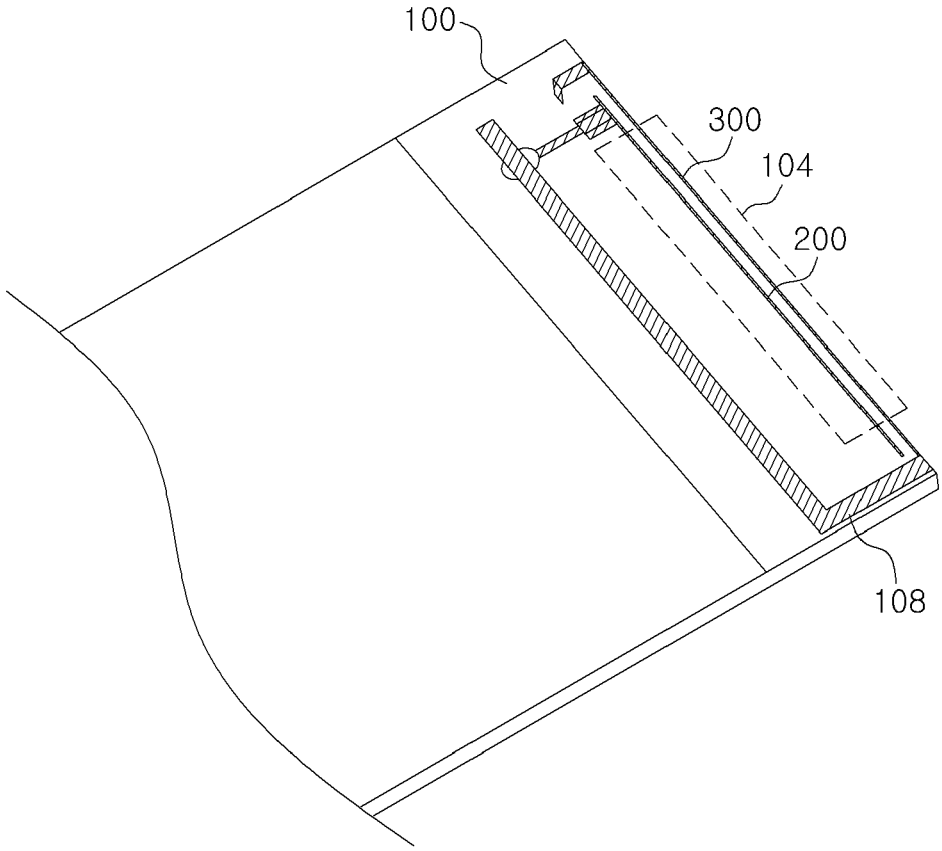
FIG. 3 is a drawing illustrating a plan view of the internal antenna for a wide band according to an embodiment of the present invention.

Referring to FIGS. 1 to 3, an internal antenna providing impedance matching for a wide band according to an embodiment of the present invention may comprise a substrate 100, a feeding point 102, an impedance matching/feeding unit 104, a ground pin 106, a radiator 108, and a feeding pin 110. Also, the impedance matching/feeding unit 104 comprises a feeding member 200 and a ground member 300.

RF signals are input to the feeding point 102, and the feeding pin 110 is electrically connected to the feeding point 102 to be formed perpendicularly on the substrate. The ground pin 106 is structured to be electrically connected to the ground of a terminal and to be formed perpendicular to the substrate.

The impedance matching/feeding unit 104 comprises a feeding member 200 that is electrically connected to the feeding pin 110 and is formed perpendicular to the substrate 100 in a designated length, and a ground member 300 that is electrically connected to the ground pin 106 and is placed perpendicular to the substrate 100 in a designated length.

Whereas FIGS. 1 to 3 illustrate an example in which the feeding member 200 and ground member 300 have linear forms, the forms of the feeding member and ground member are not thus limited and can be of a variety of types. Other forms for the feeding member and ground member will be described with reference to other drawings.

As illustrated in FIG. 3, the feeding member 200 and the ground member 300 that compose an impedance matching/feeding unit are placed apart at a designated distance.

A conventional planar inverted-F antenna has a radiator joined perpendicularly to a feeding pin and a ground pin, but an internal antenna providing impedance matching for a wide band according to an embodiment of the present invention additionally comprises a ground member 300 extending from a ground pin and a feeding member 200 extending from a feeding pin, where the feeding member 200 and the ground member 300 perform coupling feeding and impedance matching for a wide band.

RF signals provided from the feeding pin to the feeding member 200 are coupled to a ground member 300 that is separated at a designated distance, and the coupling thus achieved in a region of a designated length enables impedance matching for a wider band than does the conventional planar inverted-F antenna.

The length of the feeding member 200 and the ground member 300 for impedance matching for a wide band may be set at approximately 0.1 wavelength, but it may be adjusted according to the frequency band and operating frequency.

Also, coupling feeding whereby RF signals are transferred by coupling from the feeding member 200 to the ground member 300 is achieved at the impedance matching/feeding unit.

Whereas FIGS. 1 and 2 illustrate examples in which the feeding member 200 is formed higher than the ground member 300, the feeding member 200 and the ground member 300 may also be formed at the same height and facing each other, or the ground member 300 may be formed higher than the feeding member 200.

In other words, depending on the amount of coupling required, the height of the feeding member 200 and of the ground member 300 may be adjusted accordingly.

Figure 4:
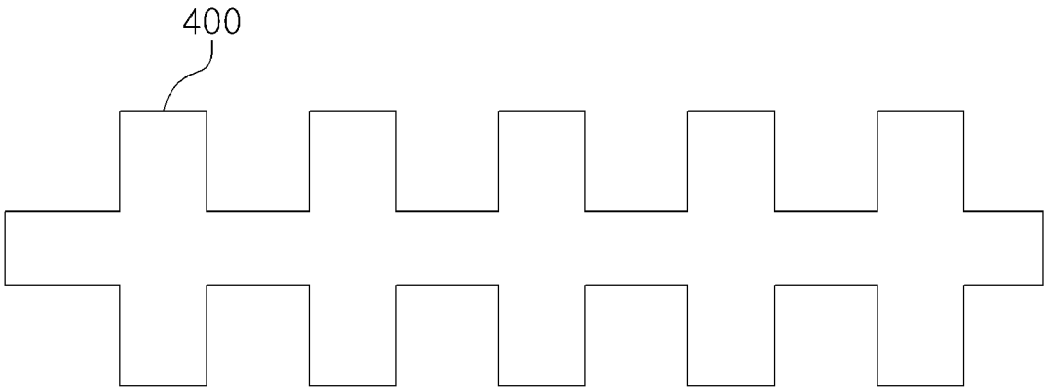
FIG. 4 is a drawing illustrating the shape of a feeding member and a ground member according to another embodiment of the present invention.

FIG. 4 is a drawing illustrating the shape of a feeding member and a ground member according to another embodiment of the present invention.

Referring to FIG. 4, a ground member or a feeding member may be used that have multiple protrusions 400 on the topside and underside of a linear form, different from the linear form illustrated in FIGS. 1 to 3.

By adding multiple protrusions 400 to a line form in this manner, even greater capacitance, necessary for coupling, may be obtained, and by means of this, impedance matching for a wider band may be performed. Also, the capacitance value has to be varied for impedance matching over a wider band, and the linear structure having protrusions on the topside and underside as in FIG. 4 can provide such varying of capacitance for coupling.

Of course, a person skilled in the art would appreciate that the feeding member and the ground member may be implemented in a variety of forms, besides the form illustrated in FIG. 4, as long as it is a structure capable of inducing coupling within a region having a designated length.

The radiator 108 extends from the ground member 300. While FIGS. 1 and 2 illustrate an example in which the radiator 108 extends from the ground member 130 perpendicularly and then bends to be parallel with the substrate, the form of the radiator is not thus limited, and various forms may be used.

The length of the radiator 108 is set according to the frequency band used, and its type may also be set in a wide variety. While FIGS. 2 and 3 illustrate an "L" shaped configuration in which the portion of the radiator parallel to the substrate is bent once, a person skilled in the art would appreciate that such cases in which the portion parallel to the substrate is implemented in linear and meandering forms may also fall within the scope of the present invention.

Whereas in an ordinary planar inverted-F antenna, a radiator is electrically connected to a feeding pin since it receives direct feed, in an antenna according to an embodiment of the present invention, the radiator 108 receives feed by way of coupling feed, and hence extends from the ground member.

Figure 5:
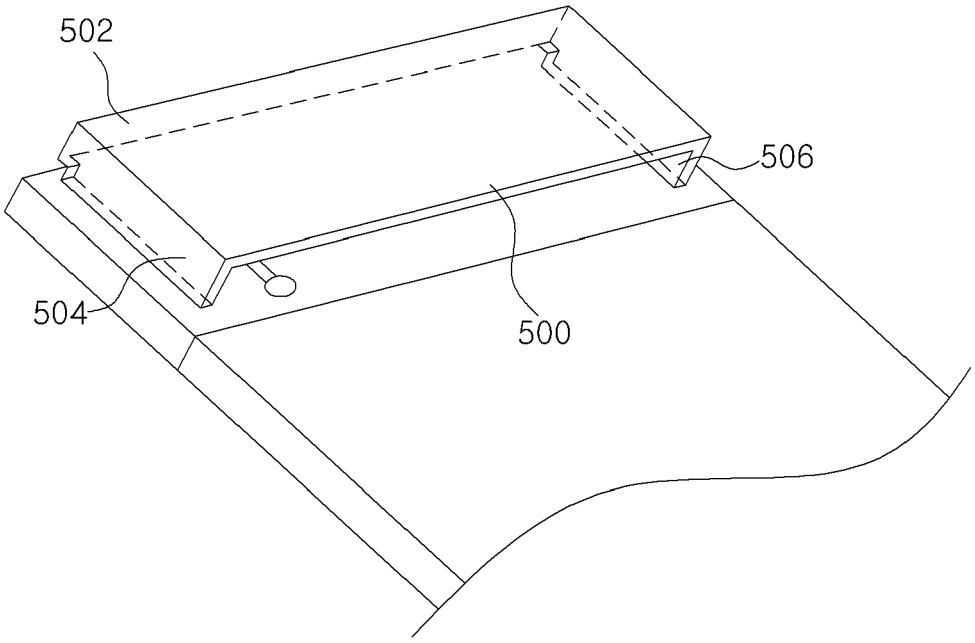
FIG. 5 is a drawing illustrating an example of an antenna carrier joined to an antenna according to an embodiment of the present invention.

FIG. 5 is a drawing illustrating an example of an antenna carrier to which an antenna according to an embodiment of the present invention is joined.

Referring to FIG. 5, an antenna carrier to which an antenna according to an embodiment of the present invention is joined may comprise a flat upper part 500 and multiple wall parts 502, 504, and 506.

The flat upper part 500 is the part to which the radiator of the antenna is joined, and has a designated area.

The multiple wall parts 502, 504 and 506 support the flat upper part 500, and are joined to the substrate. The feeding member 200 and the ground member 300 of the impedance matching/feeding unit are joined to a first wall part 502, which is relatively longer among the multiple wall parts 502, 504 and 506, while the second wall part 504 and the third wall part 506 provide support together with the first wall part 502.

Figure 6:
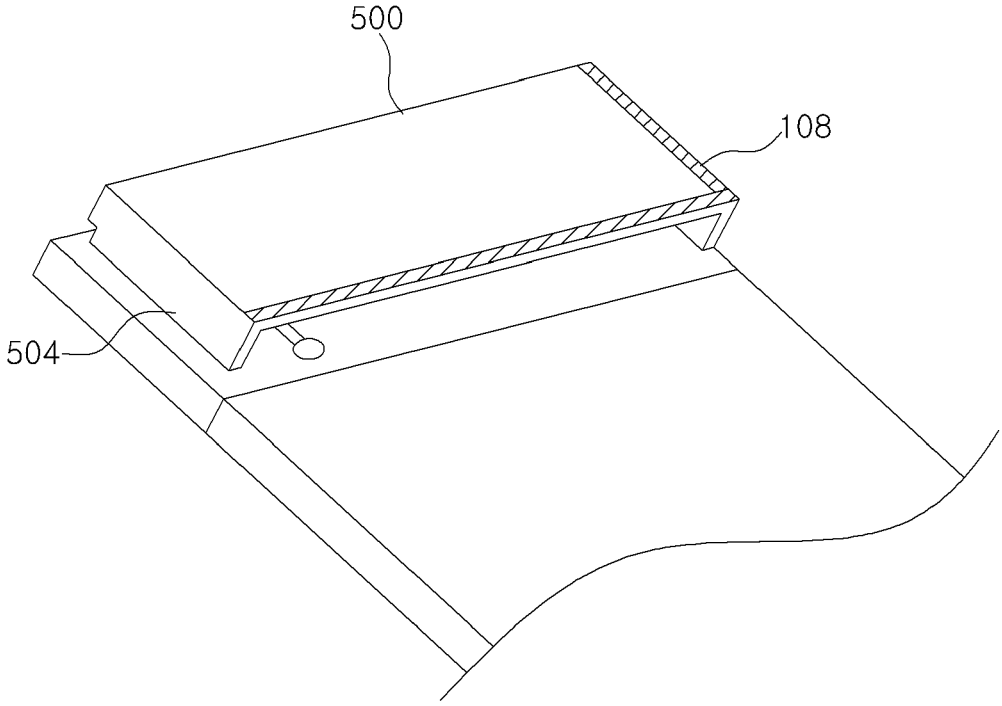
FIG. 6 is a drawing illustrating a perspective view of an antenna according to an embodiment of the present invention joined to the antenna carrier illustrated in FIG. 5.
Figure 7:
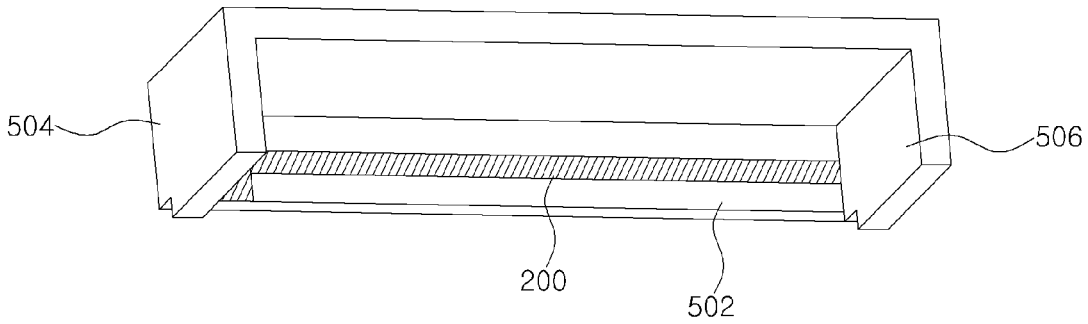
FIG. 7 is a drawing illustrating a perspective view of an antenna according to an embodiment of the present invention joined to the antenna carrier illustrated in FIG. 5 seen from another direction.

FIG. 6 is a drawing illustrating a perspective view of an antenna according to an embodiment of the present invention joined to the antenna carrier illustrated in FIG. 5, and FIG. 7 is a drawing illustrating a perspective view of an antenna according to an embodiment of the present invention joined to the antenna carrier illustrated in FIG. 5 seen from another direction. Also, FIG. 8 is a drawing illustrating a front view of the first side of a wall part of the carrier in an antenna according to an embodiment of the present invention, and FIG. 9 is a drawing illustrating the reverse side of the first side of a wall part of the carrier in an antenna according to an embodiment of the present invention.

Referring to FIGS. 6 and 7, the antenna carrier is joined to the substrate, and the wall parts 502, 504 and 506 are joined to an upper part of the substrate.

Figure 8:
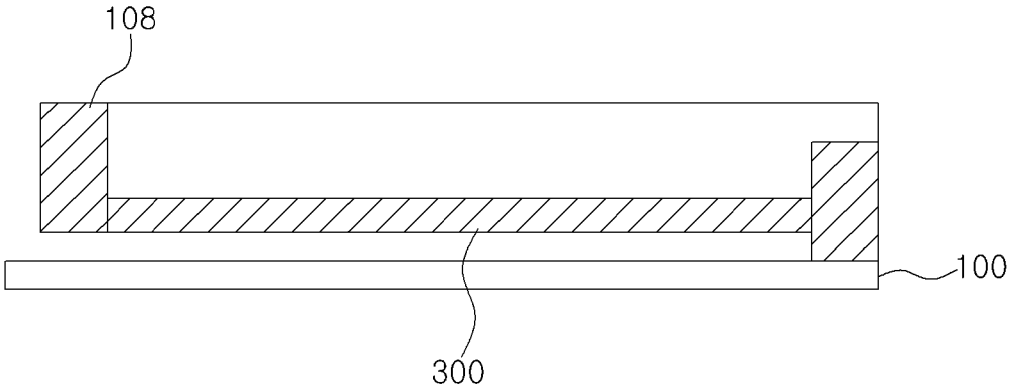
FIG. 8 is a drawing illustrating a front view of the first side of a wall part of the carrier in an antenna according to an embodiment of the present invention.
Figure 9:
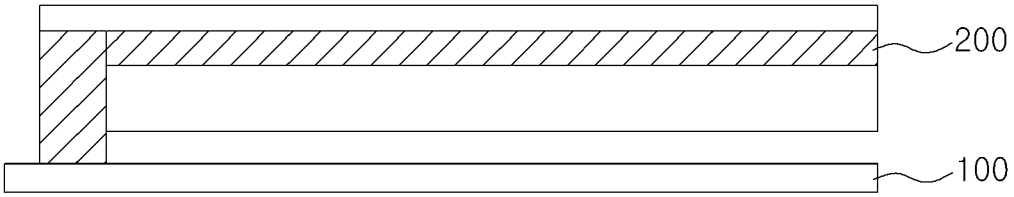
FIG. 9 is a drawing illustrating the reverse side of the first side of a wall part of the carrier in an antenna according to an embodiment of the present invention.

Referring to FIG. 8, the ground pin 106 extending perpendicularly from the substrate is formed perpendicularly along a first surface 502*a* of the first wall part 502, and the ground member 300 extends from the ground pin 106 to be formed on the first surface 502*a* of the first wall part 502.

Also, the radiator 108 extends perpendicularly from the ground member 300.

At the same time, referring to FIG. 9, the feeding pin 110 extending perpendicularly from the substrate and the feeding member 200 extending from the feeding pin 110 are joined to the second surface 502*b* of the first wall part 502, opposite the first surface 502*a*.

In other words, the feeding member 200 and the ground member 300 are separated at a designated distance with the first wall part 502 in between; the ground member 130 is joined to the first surface 502*a* of the first wall part 502, and the feeding member 120 is joined to the second surface 502*b* of the first wall part 502; and the separating distance between the ground member 300 and the feeding member 200 corresponds to the thickness of the first wall part 502.

The present invention utilizes both surfaces of the wall part of the carrier, in order to implement a structure for impedance matching for a wide band using coupling between the feeding member 200 and the ground member 300.

In this manner, the structure having elements for impedance matching and feeding formed on both surfaces of a wall part of the carrier can provide a smaller size for an antenna than does a conventional structure that has elements for feeding and impedance matching formed on the flat upper side of the carrier.

The radiator 108 extending from the first wall part 502 is joined to the flat upper part 500 of the carrier.

The invention claimed is:

1. An internal antenna providing impedance matching for a wide band, comprising:

a substrate;

a carrier joined on the substrate;

an impedance matching/feeding unit comprising a ground member and a feeding member, the ground member joined to a first surface of one of wall parts of the carrier and electrically connected to a ground, the feeding member joined to a second surface opposite the first side to receive a feed of RF signals; and a radiator extending from the ground member and joined to the carrier.

2. The internal antenna providing impedance matching for a wide band according to claim 1, wherein the first side has a ground pin joined thereto, the ground pin electrically connected to a ground and formed perpendicularly from the substrate to be connected to the ground member, and the second side has a feeding pin joined thereto, the feeding pin electrically connected to a feeding point and formed perpendicularly from the substrate to be connected to the feeding member.

3. The internal antenna providing impedance matching for a wide band according to claim 1, wherein the carrier is equipped with a flat upper part formed over an upper part of the wall parts, and the radiator extends from the ground member to be formed over the flat upper part.

* * * * *